US007671815B2

(12) United States Patent
Thornell-Pers et al.

(10) Patent No.: US 7,671,815 B2
(45) Date of Patent: Mar. 2, 2010

(54) ANTENNA DEVICE AND PORTABLE RADIO COMMUNICATION DEVICE COMPRISING SUCH AN ANTENNA DEVICE

(75) Inventors: Anders Thornell-Pers, Stadigvarande bostad (SE); Torsten Östervall, Stadigvarande bostad (SE)

(73) Assignee: Laird Technologies, AB, Kista (SE)

( * ) Notice: Subject to any disclaimer, the term of this patent is extended or adjusted under 35 U.S.C. 154(b) by 848 days.

(21) Appl. No.: 10/553,899

(22) PCT Filed: Apr. 23, 2004

(86) PCT No.: PCT/SE2004/000629

§ 371 (c)(1),
(2), (4) Date: Jul. 12, 2006

(87) PCT Pub. No.: WO2004/095633

PCT Pub. Date: Nov. 4, 2004

(65) Prior Publication Data

US 2006/0262015 A1 Nov. 23, 2006

(30) Foreign Application Priority Data

Apr. 24, 2003 (SE) ..... 0301200

(51) Int. Cl.
*H01Q 1/24* (2006.01)
*H01Q 5/00* (2006.01)

(52) U.S. Cl. ..... 343/722; 343/702

(58) Field of Classification Search ..... 343/700 MS, 343/722, 860, 702
See application file for complete search history.

(56) References Cited

U.S. PATENT DOCUMENTS 4,068,232 A * 1/1978 Meyers et al. ..... 342/44
4,382,238 A 5/1983 Makimoto et al.
6,061,025 A 5/2000 Jackson et al.

(Continued)

FOREIGN PATENT DOCUMENTS

GB 2375905 11/2002

(Continued)

OTHER PUBLICATIONS

International Bureau Notification Concerning Transmittal of International Preliminary Report on Patentability (Chapter I of the Patent Cooperation Treaty) Nov. 10, 2005.

*Primary Examiner*—Michael C Wimer
(74) *Attorney, Agent, or Firm*—Harness, Dickey & Pierce, P.L.C.

(57) ABSTRACT

A multi-band antenna device for a portable radio communication device has first and second radiating elements (10, 20). A controllable switch (30) is arranged between the radiating elements for selectively interconnecting and disconnecting thereof. The state of the switch is controlled by means of a control voltage input (VSwitch). A filter (40) that blocks radio frequency signals is arranged between the feeding portion and the control voltage input. A DC blocking arrangement (50) is arranged between a grounding portion (14) on the first radiating element and ground wherein the first and second radiating element are generally planar and arranged at a predetermined distance above a ground plane. By means of this arrangement, two broad and spaced apart frequency bands are obtained with retained performance and small overall size of the antenna device. A communication device comprising such an antenna device is also provided.

20 Claims, 4 Drawing Sheets

U.S. PATENT DOCUMENTS

| | | | |
|---|---|---|---|
| 6,501,427 | B1 | 12/2002 | Lilly et al. |
| 2002/0196185 | A1 | 12/2002 | Bloy |

FOREIGN PATENT DOCUMENTS

| | | | |
|---|---|---|---|
| JP | 6220080 | A | 9/1987 |
| JP | 1019034 | A | 7/1998 |
| JP | 10190344 | A | 7/1998 |
| JP | 1129823 | A | 10/1999 |
| JP | 2000-236209 | | 8/2000 |
| WO | WO 01/20718 | A1 | 3/2001 |

* cited by examiner

ANTENNA DEVICE AND PORTABLE RADIO COMMUNICATION DEVICE COMPRISING SUCH AN ANTENNA DEVICE

FIELD OF INVENTION

The present invention relates generally to antenna devices and more particularly to a controllable internal multi-band antenna device for use in portable radio communication devices, such as in mobile phones. The invention also relates to a portable radio communication device comprising such an antenna device.

BACKGROUND

Internal antennas have been used for some time in portable radio communication devices. There are a number of advantages connected with using internal antennas, of which can be mentioned that they are small and light, making them suitable for applications wherein size and weight are of importance, such as in mobile phones. A type of internal antenna that is often used with portable radio communication devices is the so-called Planar Inverted F Antenna (PIFA).

However, the application of internal antennas in a mobile phone puts some constraints on the configuration of the antenna, such as the dimensions of the radiating element or elements, the exact location of feeding and grounding portions etc. These constraints may make it difficult to find a configuration of the antenna that provides a wide operating band. This is particularly important for antennas intended for multi-band operation, wherein the antenna is adapted to operate in two or more spaced apart frequency bands. In a typical dual band phone, the lower frequency band is centered on 900 MHz, the so-called GSM 900 band, whereas the upper frequency band is centered around 1800 or 1900 MHz, the DCS and PCS band, respectively. If the upper frequency band of the antenna device is made wide enough, covering both the 1800 and 1900 MHz bands, a phone operating in three different standard bands is obtained. In the near future, antenna devices operating four or even more different frequency bands are envisaged.

The number of frequency bands in passive antennas is limited by the size of the antenna. To be able to further increase the number of frequency bands and/or decrease the antenna size, active frequency control can be used. An example of active frequency control is disclosed in the Patent Abstracts of Japan 10190347, which discloses a patch antenna device capable of coping with plural frequencies. To this end there are provided a basic patch part and an additional patch part which are interconnected by means of PIN diodes arranged to selectively interconnect and disconnect the patch parts. Although this provides for a frequency control, the antenna device still has a large size and is not well adapted for switching between two or more relatively spaced apart frequency bands, such as between the GSM and DCS/PCS bands. Instead, this example of prior art devices is typical in that switching in and out of additional patches has been used for tuning instead of creating additional frequency band at a distance from a first frequency band.

The Patents Abstracts of Japan publication number JP2000-236209 discloses a monopole antenna comprising a linear conductor or on a dielectric substrate, see FIG. 1. Radiation parts of the antenna are composed of at least two metal pieces connected through diode switch circuits. The radiation elements have feed points connected to one end of a filter circuit, which cuts of a high-frequency signal. A signal $V_{Scwitch}$ is used to control the diode switch. The disclosed configuration is limited to monopole or dipole antennas. Also, the object of the antenna according to the above mentioned Japanese document is not to provide an antenna with a small size.

A problem in prior art antenna devices is thus to provide a multi-band antenna of the PIFA type with a small size and volume and broad frequency bands which retains good performance.

SUMMARY OF THE INVENTION

An object of the present invention is to provide an antenna device of the kind initially mentioned wherein the frequency characteristics provides for at least two comparatively wide frequency bands while the overall size of the antenna device is small.

Another object is to provide an antenna device having better multi-band performance than prior art devices.

The invention is based on the realization that several frequency bands can be provided in a physically very small antenna by arranging the antenna so that in at least two frequency modes the antenna utilizes the first resonance of the antenna structure. This is made possible by providing a filter arrangement between a radiating element and ground in an antenna device wherein two radiating elements are selectively interconnectable by means of a switch and a filter arrangement between the feeding portion and the switching arrangement blocks RF signals.

According to a first aspect of the present invention there is provided an antenna device as defined in claim 1.

According to a second aspect of the present invention there is provided portable radio communication device as defined in claim 16.

Further preferred embodiments are defined in the dependent claims.

The invention provides an antenna device and a portable radio communication device wherein the problems in prior art devices are avoided or at least mitigated. Thus, there is provided a multi-band antenna device having an antenna volume as small as about 2 $cm^3$ which means a size of the antenna that is reduced as compared to standard multi-band patch antennas but still with maintained RF performance. Also, the bandwidths of the antenna device according to the invention can be improved as compared to corresponding prior art devices but without any increase in size, which is believed to be a result of the use of the basic frequency mode of the antenna structure. As an example thereof, bandwidths of as much as 15% of the centre frequency of the higher frequency band have been obtained as compared to 9-10% in conventional prior art antenna devices.

The filter is preferably a low-pass filter, providing an efficient RF blocking arrangement.

The switch is preferably a PIN diode, having good properties when operating as an electrically controlled switch.

BRIEF DESCRIPTION OF DRAWINGS

The invention is now described, by way of example, with reference to the accompanying drawings, in which.

DETAILED DESCRIPTION OF THE INVENTION

In the following, a detailed description of preferred embodiments of an antenna device according to the invention will be given. In the description, for purposes of explanation and not limitation, specific details are set forth, such as particular hardware, applications, techniques etc. in order to provide a thorough understanding of the present invention. However, it will be apparent to one skilled in the art that the present invention may be utilized in other embodiments that depart from these specific details. In other instances, detailed descriptions of well-known methods, apparatuses, and circuits are omitted so as not to obscure the description of the present invention with unnecessary details.

Figure 1:
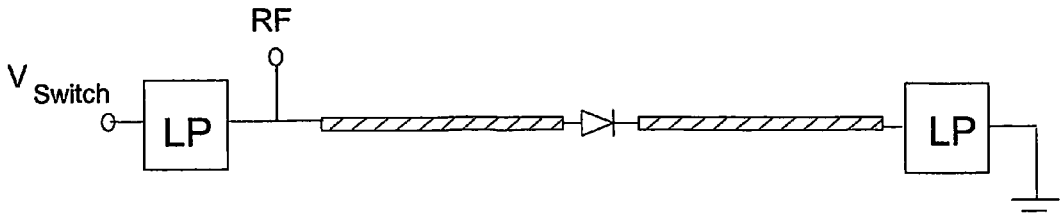
Fig. 1 (Prior Art)
FIG. 1 is a description of a prior art monopole antenna.

FIG. 1 has been described in the background section and will not be dealt with further.

Figure 2:
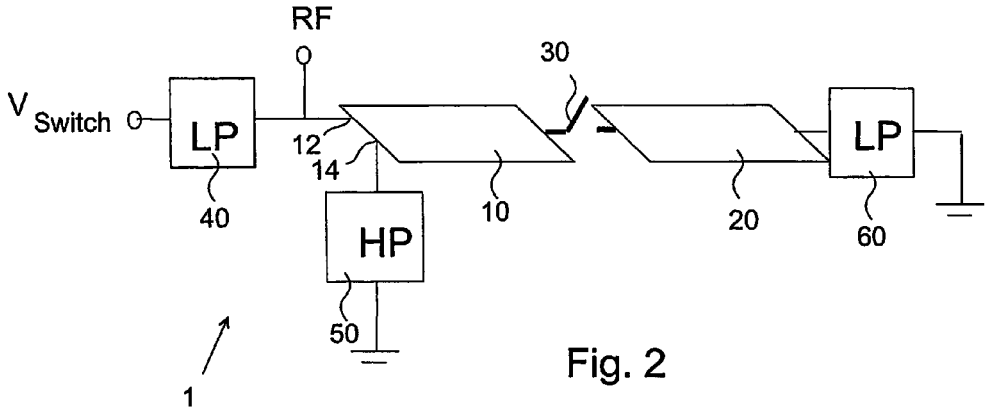
FIG. 2 shows a schematic diagram of a PIFA antenna device according to the invention.

In FIG. 2, there is shown an antenna device, generally designated 1. The antenna device comprises a first generally planar rectangular radiating element 10 made of an electrically conductive material, such as a sheet metal or a flex film, as is conventional. A source RF of radio frequency signals, such as electronic circuits of a portable radio communication device, is connected to a feeding portion 12 of the first radiating element.

The antenna device also comprises a second generally planar rectangular radiating element 20. A switch element 30 is provided between the two radiating elements 10, 20. This switch element is preferably a PIN diode, i.e., a silicon junction diode having a lightly doped intrinsic layer serving as a dielectric barrier between p and n layers. Ideally, a PIN diode switch is characterized as an open circuit with infinite isolation in open mode and as an short circuit without resistive losses in closed mode, making it suitable as an electronic switch. In reality the PIN diode switch is not ideal. In open mode the PIN diode switch has capacitive characteristic (0.1-0.4 pF) which results in finite isolation (15-25 dB @1 GHz) and in closed mode the switch has resistive characteristic (0.5-3 ohm) which results in resistive losses (0.05-0.2 dB).

The first and second radiating elements 10, 20 are arranged at a predetermined distance above a ground plane, such as a printed circuit board described below under reference to FIG. 4.

A DC control input for controlling the operation of the PIN diode, designated $V_{Switch}$ in the figures, is connected to the first radiating element 10 via a filter block 40 to not affect the RF characteristics of the antenna device. This means that the filter characteristics of the filter block 40 is designed so as to block RF signals. In the preferred embodiment, the filter block 40 comprises a low pass filter.

A grounding portion 14 of the first radiating element 10 is connected to ground via a DC blocking arrangement in the form of a high pass filter 50. The function of this arrangement is to provide for the necessary connection to ground for the described PIFA antenna, i.e., to let the RF signals pass to ground, while simultaneously block DC currents from the DC control input from reaching ground before going through the PIN diode. The DC control thus creates a DC current through the PIN diode to make it conductive.

Finally, the second radiating element is connected to ground via a second low pass filter block 60. This second low pass filter is provided so that the grounding of the second radiating element will not adversely affect the RF characteristics of this radiating element.

Figure 3:
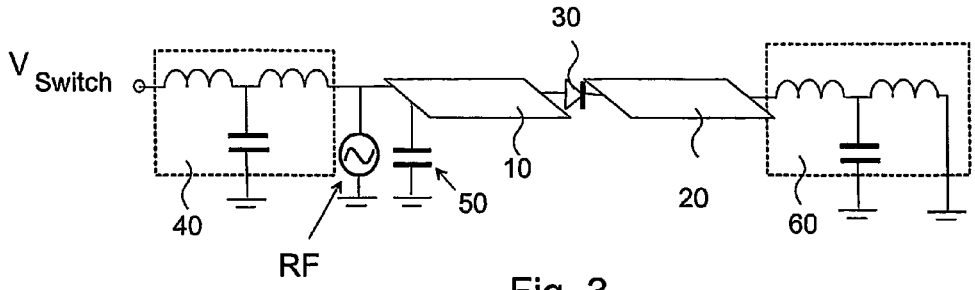
FIG. 3 is a more detailed diagram of the antenna device shown in FIG. 1.

A more detailed diagram of the antenna device is shown in FIG. 3. It is here shown that each of the low pass filter blocks consists of two inductors and one capacitor arranged between the two inductors and ground. The DC blocking arrangement 50 comprises a capacitor arranged between the first radiating element and ground. In the preferred embodiment, both the feeding portion 12 and the grounding portion 14 connected to the DC blocking capacitors are arranged at the same side of the first radiating element and preferably at a short side thereof.

The antenna is preferably designed to 50 Ohms.

Figure 4:
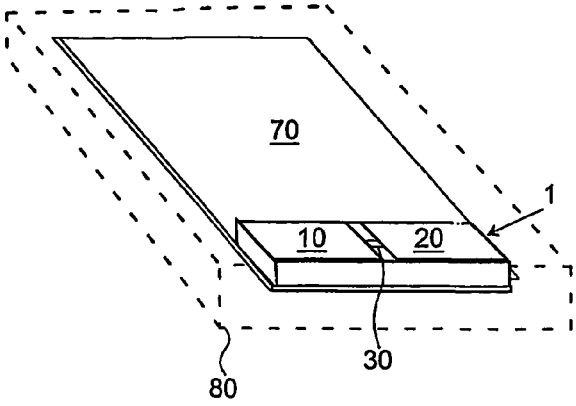
FIG. 4 is an overview of a printed circuit board arranged to be fitted in a portable communication device and having an antenna device according to the invention.

In FIG. 4 there is shown the two radiating elements 10, 20 arranged generally parallel to and spaced apart from a printed circuit board (PCB) 70 adapted for mounting in a portable communication device 80, such as a mobile phone. The PCB functions as a ground plane for the antenna device. The general outlines of the communication device is shown in dashed lines in FIG. 4. Typical dimensions for the antenna device 1 is a height of approximately 4 millimeters and a total volume of about 2 $cm^3$.

It will be appreciated that all components except for the two radiating elements 10, 20 and the switch element 30 can be provided on the PCB, thus facilitating easy assembly of the antenna device. This is further facilitated by the fact that there is no separate feeding of the switch element.

The antenna device functions as follows. The RF source and other electronic circuits of the communication device 80 operate at a given voltage level, such as 1.5 Volts. The criterion is that the voltage level is high enough to create the necessary voltage drop across the PIN diode, i.e. about 1 Volt. This means that the control voltage $V_{Switch}$ is switched between the two voltages "high" and "low", such as 1.5 and 0 Volts, respectively. When $V_{Switch}$ is high, there is a voltage drop across the PIN diode 30 and a corresponding current therethrough of about 5-15 mA. This voltage drop makes the diode conductive, effectively electrically interconnecting the two radiating elements 10, 20.

With the two radiating elements interconnected, i.e., with the switch element "closed", both radiating elements are active working as one large element with a resonance frequency corresponding to a lower frequency band.

With the control voltage $V_{Switch}$ "low", there is an insufficient voltage drop across the PIN diode 30 to make it conductive, i.e., it is "open". The second radiating element is then effectively disconnected from the first one and only the first radiating element functions as one small element with a higher resonance frequency corresponding to a higher frequency band.

The size and configuration of the two radiating elements are chosen so as to obtain the desired resonance frequencies. Thus, the size and configuration of the first radiating element 10 determines the resonance frequency of the higher frequency band while the combination of the first and second radiating elements 10 and 20 determines the resonance frequency of the lower frequency band. In a preferred embodiment, the two radiating elements are of similar configuration so as to cover the 900 and 1800/1900 MHz bands.

A conventional production method of antenna devices is to provide an electrically conductive layer forming the radiating portions of the antenna on a carrier made of a non-conductive material, such as a polymer or other plastic material. The carrier is thus made of a heat-sensitive material and a small heating area is desired to keep the temperature as low as possible when soldering components to the antenna device.

Figure 5:
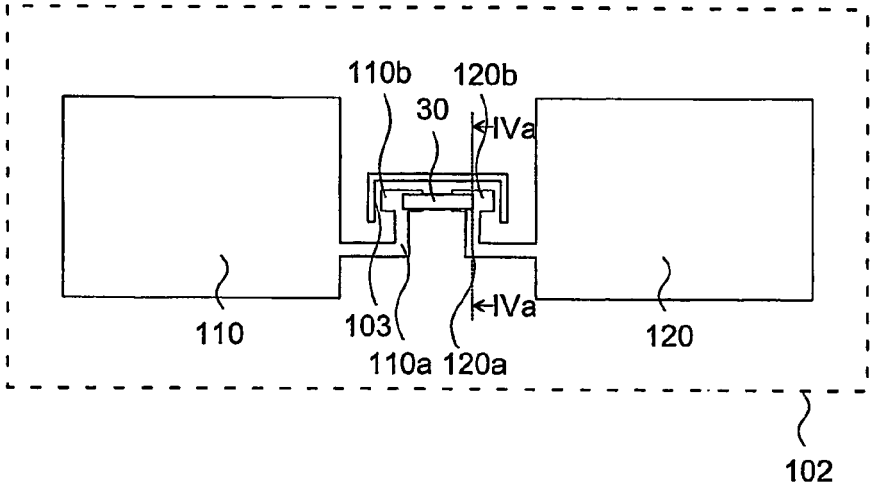
FIG. 5 shows an alternative radiating element configuration.

In FIG. 5 there is shown an alternative configuration of the radiating elements, combining soldering pads for a PIN diode with heat traps for efficient soldering operation while providing a large overall distance between the two radiating elements. Each of the radiating elements 110, 120 comprises a narrow portion 110*a*, 120*a* protruding from the otherwise generally rectangular shape. The protruding portions end in a respective pad 110*b*, 120*b* to which a switching element in the form of a PIN diode 30 is mounted by means of soldering, for example. By means of this configuration, interference between the two radiating elements are minimized as the general mutual distance therebetween is larger than in the embodiment described with reference to FIGS. 2-4. In order to keep the interference between the radiating elements at acceptable levels, it has been found that they should be separated by at least 3 millimeters, and preferably more. Also, by providing the connection portions in the form of pads separated from the main radiating elements by narrow connection portions, heating energy for soldering is kept low, thus minimizing damage to the carrier structure.

Figure 5A:
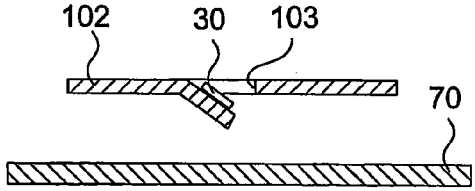
FIG. 5*a* shows a cross-sectional view along the line IVa-IVa of the radiating element shown in FIG. 4.

In order to minimize the overall height of the antenna device, thereby saving space in the radio communication device in which the antenna device is mounted, an essentially C-shaped slit 103 is provided in the carrier 102 around the area in which the PIN diode is mounted. By means of this slit, the area of the carrier in which the PIN diode is provided can be depressed, see the cross-sectional view of FIG. 5*a*. The PIN diode is provided so that it is below the upper surface of the carrier 102, thus maintaining an overall height of the antenna arrangement essentially corresponding to the distance between the radiating elements 110, 120 and the PCB 70.

Figure 6:
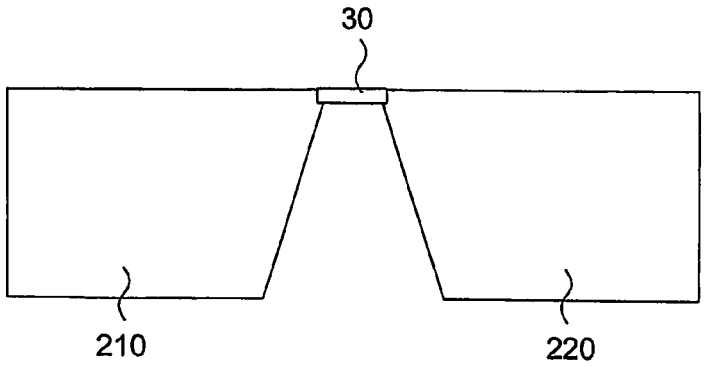
FIG. 6 shows yet an alternative radiating element configuration.

In an alternative embodiment shown in FIG. 6, the mutual distance between the two radiating elements 210, 220 is kept large due to the non-rectangular configuration of the elements. In FIG. 6 the sides of the radiating elements facing each other are diverging from the portion where the PIN diode 30 interconnects the two radiating elements.

Figure 7:
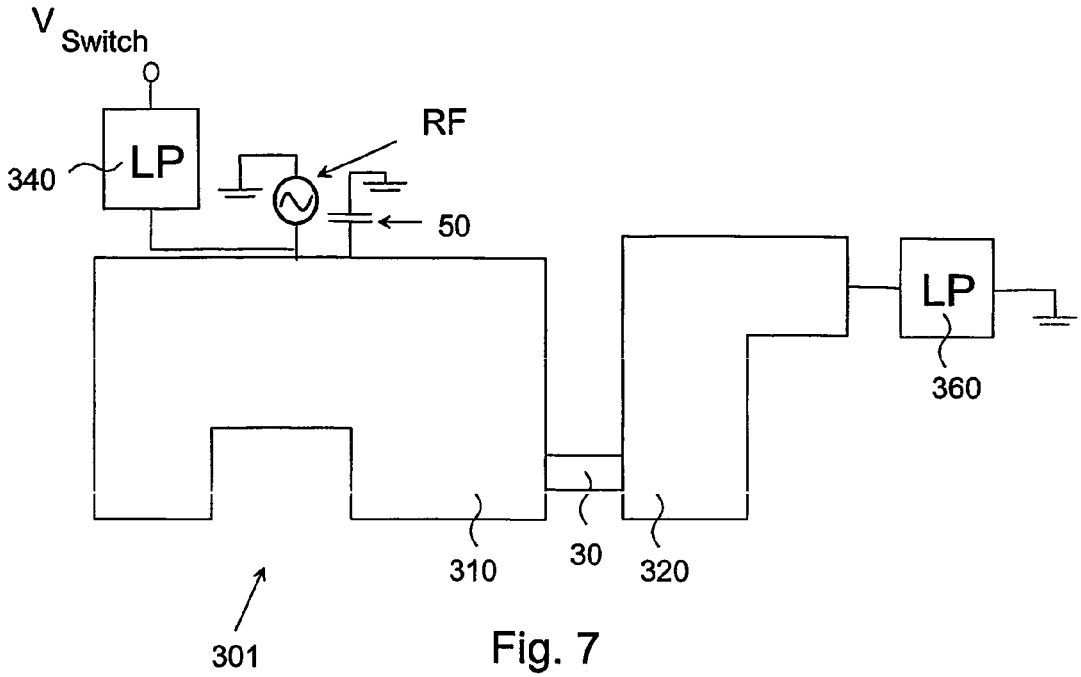
FIG. 7 shows an alternative embodiment wherein one radiating element provides for two resonance frequencies by itself.

The first radiating element can itself have a configuration that provide for more than one frequency band. An example thereof is shown in FIG. 7, wherein the first radiating element 310 has a general C shape, providing for two resonance frequencies by itself. This provides for an RF characteristics which incorporates a lower frequency band having two resonance frequencies—one provided by the first radiating element itself and one provided by the combination of the first and second radiating elements with the PIN diode conductive, i.e., the switch closed, essentially creating one wider frequency band. There is also an upper frequency band having one resonance frequency provided by the first radiating element with the PIN diode non-conductive, i.e., the switch open.

The inventive idea of using two radiating element for creating two spaced apart frequency bands of the antenna device can be further improved by the use of the second radiating element as a slave element. This idea is thus applicable when the first radiating element provides both for one resonance frequency, such as in FIG. 3, and for two resonance frequencies, such as in FIG. 7. This is realized in FIG. 8, wherein the second radiating element 420 is grounded at frequencies of one frequency band. This is accomplished by replacing the second low pass filter 60 shown in FIG. 2 with a band-stop filter 460 having the S21 characteristics shown in FIG. 8*a*. Thus, at the lower frequency band LB the band-pass filter 460 essentially blocks any signals while it is essentially short-circuited to ground at the higher frequency band HB. By means of the slave radiator, the width of the higher frequency band is further increased.

Figure 8:
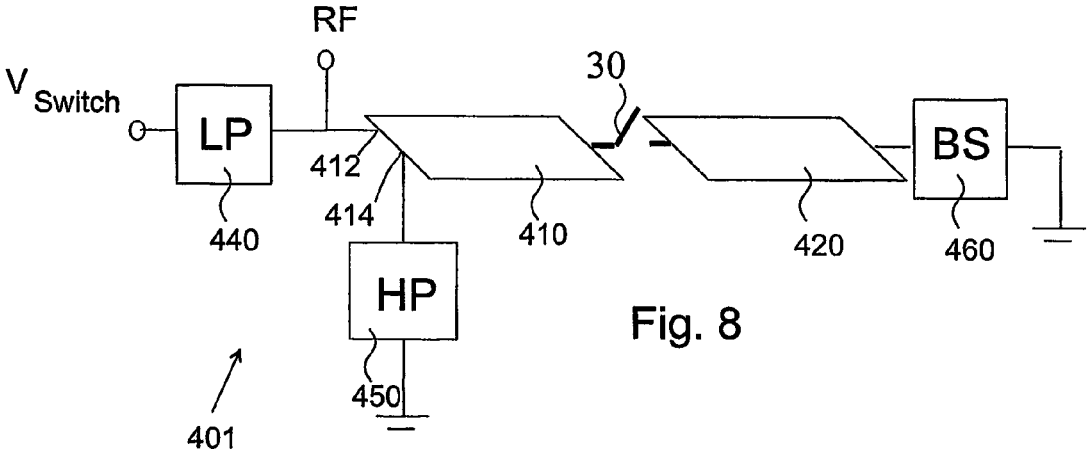
FIGS. 8 and 8*a* show an alternative embodiment wherein one radiating element is used as a slave radiator.
Figure 8A:
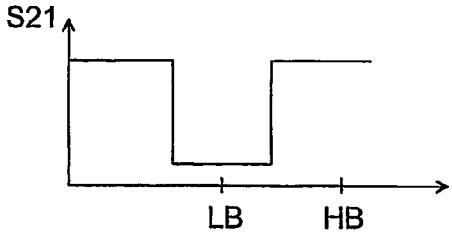
Figure 9:
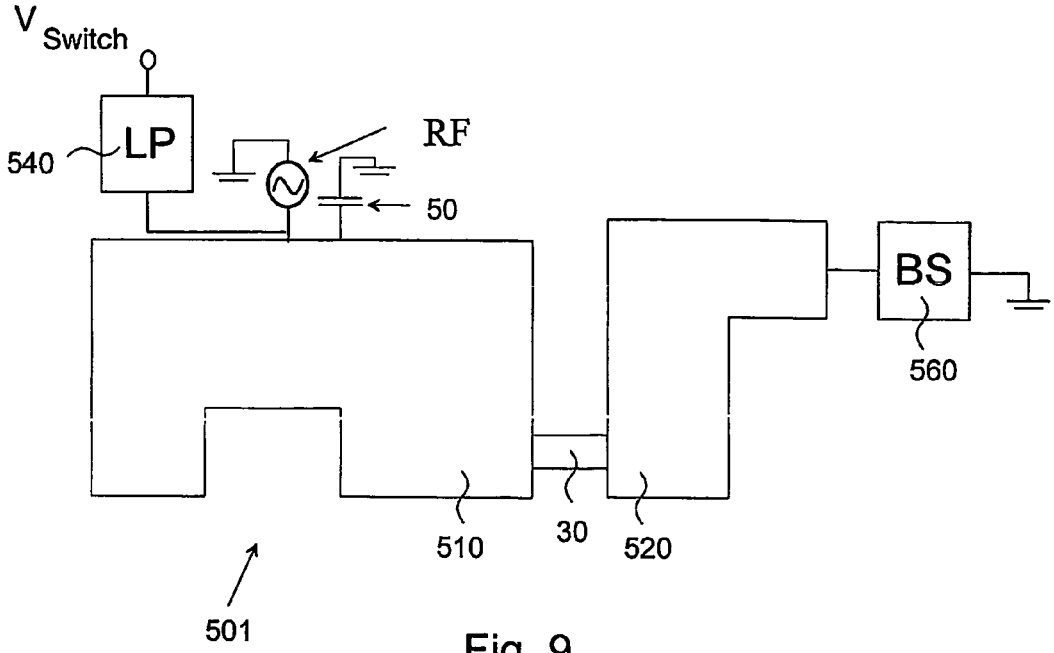
FIG. 9 shows an alternative embodiment combining a radiating element providing for two resonance frequencies and a radiating element used as a slave radiator.

A combination of the use of a radiating element providing for two resonance frequencies by itself, as shown in FIG. 7, and the use of a radiating element as a slave element, as shown in FIG. 8, will now be described with reference to FIG. 9. The general configuration is similar to the one in FIG. 7 with a first radiating element 510 with a general C shape, providing for two resonance frequencies by itself, and a second radiating element 520 connected to ground via a band-pass filter 560, -thus operating as a slave element. With this arrangement, four resonance frequencies are obtained, essentially providing for a quad band antenna device.

Preferred embodiments of an antenna device according to the invention have been described. However, it will be appreciated that these can be varied within the scope of the appended claims. Thus, a PIN diode has been described as the switch element. It will be appreciated that other kinds of switch elements can be used as well.

A second low pass filter block 60 has been shown in FIGS. 2 and 3 after the second radiating element 20. It will be appreciated that this filter block can be omitted and the second connected directly to ground without deviating from the inventive idea, although the performance of the antenna device in that case is somewhat degraded in the case the antenna device is a PIFA.

The radiating elements in FIGS. 2 and 3 have been described as being essentially planar and generally rectangular. It will be appreciated that the radiating elements can take any suitable shape, such as being bent to conform with the casing of the portable radio communication device in which the antenna device is mounted.

One switch 30 has been shown to interconnect the two radiating elements. It will be appreciated that more than one switch, such as several parallel PIN diodes can be used without deviating from the inventive idea.

Common kinds of mobile phones are the so-called "fold phones" or "slide phones". In such phones it is preferred to have the position of the movable portion of the phone control the switch. Thus, when the phone is in talk position, i.e., open and extended position, respectively, the switch is closed, thereby tuning the resonance back to the same frequency as in closed mode of the phone.

Figure 10:
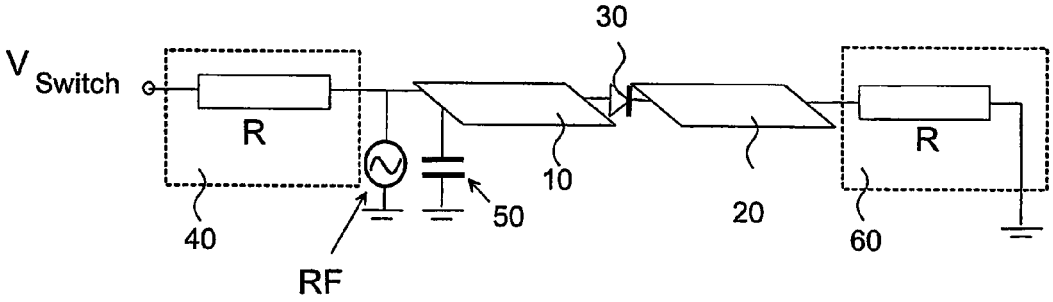
FIG. 10 shows an alternative embodiment wherein resistors are used as filters.

The low pass filter blocks 40 and 60 have been shown in FIG. 3 as comprising capacitors and inductors. In an alternative embodiment shown in FIG. 10, the capacitors and inductors are replaced by a pure resistor in each filter block, i.e., the impedance of the filter blocks 40 and 60 are purely resistive (R). In all other aspects this embodiment is identical to the one shown in FIG. 3. Due to the low DC current required to switch the PIN diode, a high resistance can be used in the filter blocks, such as 800 Ohms. This in turn provides filter blocks blocking RF signals.

This use of resistors has several advantages. Firstly, a resistor is a very inexpensive component. Secondly, resistors are suitable for manual assembling. Using resistors as filters is not limited to the disclosed embodiments but can be used with any application wherein a low current provides selective switching of antenna elements in an antenna device.

The invention claimed is:

1. An antenna device for a portable radio communication device operable in at least a first and a second frequency band, the antenna device comprising:

a first electrically conductive radiating element having a feeding portion connected to a feed device of the radio communication device;

a second electrically conductive radiating element having a grounding portion connectable to ground;

a controllable switch arranged between the first and second radiating elements for selectively interconnecting and disconnecting the radiating elements, the state of the switch being controlled by means of a control voltage input;

a first filter arranged between the feeding portion and the control voltage input, wherein the first filter is arranged to block radio frequency signals;

a grounding portion of the first radiating element;

a high pass filter arranged between the grounding portion of the first radiating element and ground; and a band-stop filter connected to the grounding portion of the second radiating element and being connectable to ground, the band-stop filter having a stop band at the lower of the first and second frequency bands;

wherein the first and second radiating elements are generally planar and arranged at a predetermined distance above a ground plane.

2. The antenna device according to claim 1, wherein the first filter is a low pass filter.

3. The antenna device according to claim 1, wherein the switch comprises a PIN diode.

4. The antenna device according to claim 1, wherein the first radiating element is configured for more than one resonance frequency.

5. The antenna device according to claim 1, wherein the feeding portion of the first radiating element and the grounding portion connected to the high pass filter are arranged on a same side of the first radiating element.

6. The antenna device according to claim 1, wherein at least one of the first and second radiating elements comprises a protruding portion, and wherein the switch is connected to the protruding portion.

7. The antenna device according to claim 1, comprising a generally planar printed circuit board, wherein the first and second radiating elements and the switch are arranged generally parallel to and spaced apart from the printed circuit board.

8. The antenna device according to claim 1, wherein the antenna device has a volume less than 3 $cm^3$.

9. The antenna device according to claim 1, wherein the antenna device is a PIFA.

10. The antenna device according to claim 1, wherein the position of the portable radio communication device is used to control the switch.

11. The antenna device according to claim 1, wherein the impedance of the first filter is purely resistive.

12. A portable radio communication device, comprising a generally planar printed circuit board, the antenna device of claim 1 connected to a feed device with electronic circuits provided for transmitting and/or receiving RF signals, and a ground device.

13. The antenna device according to claim 1, wherein the first filter consists of two inductors and one capacitor.

14. The antenna device according to claim 1, wherein the antenna device is configured to 50 Ohms.

15. The antenna device according to claim 1, wherein the antenna device has a height of about 4 millimeters.

16. The antenna device according to claim 1, wherein the antenna device has a volume of about 2 $cm^3$.

17. The antenna device according to claim 1, wherein the first and second radiating elements are configured so as to cover the 900 and the 1800/1900 Megahertz bands.

18. The antenna device according to claim 1, wherein the first radiating elements are spaced apart by at least 3 millimeters.

19. The antenna device according to claim 1, wherein:

when there is a sufficient voltage drop across the switch of at least 1 Volt, the switch is configured to electrically interconnect the first and second radiating elements to be operable with a resonance frequency corresponding to the lower of the first and second frequency bands; and when there is an insufficient voltage drop across the switch of less than 1 Volt, the switch is configured to disconnect the first and second radiating elements such that the first radiating element is only operable with a resonance frequency corresponding to the higher of the first and second frequency bands.

20. The antenna device according to claim 1, wherein the band-stop filter is operable for blocking signals at the lower of the first and second frequency bands, while short-circuiting to ground signals at the higher of the first and second frequency bands.

* * * * *